United States Patent [19]

Frantz et al.

[11] Patent Number: 4,585,292

[45] Date of Patent: Apr. 29, 1986

[54] OVERMOLDED SHIELDED CONNECTOR

[75] Inventors: Robert H. Frantz, Newville; Mark H. Waters, Harrisburg; Charles E. Reynolds, Mechanicsburg, all of Pa.

[73] Assignee: AMP Incorporated, Harrisburg, Pa.

[21] Appl. No.: 682,045

[22] Filed: Dec. 14, 1984

Related U.S. Application Data

[63] Continuation-in-part of Ser. No. 607,073, May 4, 1984.

[51] Int. Cl.[4] ..... H01R 13/46

[52] U.S. Cl. ..... 339/143 R

[58] Field of Search ..... 339/143 R, 208, 141

[56] References Cited

U.S. PATENT DOCUMENTS

| | | | |
|---|---|---|---|
| 3,977,755 | 8/1976 | Edel et al. | 339/143 R |
| 4,062,616 | 12/1977 | Shaffer et al. | 339/99 R |
| 4,408,823 | 10/1983 | Huber | 339/208 |
| 4,435,035 | 3/1984 | Berry et al. | 339/208 |
| 4,453,798 | 6/1984 | Asick et al. | 339/143 R |
| 4,457,576 | 7/1984 | Cosmos et al. | 339/143 R |

FOREIGN PATENT DOCUMENTS

| | | | |
|---|---|---|---|
| 0040941 | 12/1981 | European Pat. Off. | 339/143 R |
| 0090539 | 10/1983 | European Pat. Off. | 339/143 R |

*Primary Examiner*—Gil Weidenfeld
*Assistant Examiner*—Gary F. Paumen
*Attorney, Agent, or Firm*—Russell J. Egan; F. Brice Faller

[57] ABSTRACT

An improved shielded and insulated electrical connector for terminating shielded multiconductor cable is formed by a pair of mating metal shield members which engage a peripheral metal shell means on a standard connector and enclose the rear conductor exiting portion thereof. The shield members each include embossed strengthening means as well as interengaging side walls to completely enclose the rear of an electrical connector. At least one shield member is provided with at least one overmolding pressure relief means which opens at a predetermined pressure and allows a limited amount of overmolding insulating material to enter the cavity defined by the shield members while equalizing the inner and outer shield member pressures. The shield members also include gripping means which allow overmolding insulative material to enter and harden thereby becoming fixedly attached to the shield members to prevent withdrawal due to shrinking as the overmold insulative material cools. At least one of the shield members is preferably provided with continuity lances which positively engage the metal shell of the connector to assure good electrical contact therewith. The shield members include latching means and they are held together by a crimp ring which secures the cable shield thereto.

7 Claims, 10 Drawing Figures

OVERMOLDED SHIELDED CONNECTOR

This application is a continuation-in-part of our copending patent application Ser. No. 607,073 filed May 4, 1984, and includes improvements over this original disclosure.

The present invention relates to a shielded connector which is overmolded with an insulative layer and in particular to an improved metal shield which will withstand high pressures generated in an overmolding operation applying the insulative layer.

The present FCC requirements have caused the increased use of shielding in electrical connectors. While many forms of shielding have proven to be quite satisfactory, they are not always aesthetically pleasing. For this reason it has been found that shielded connectors which are overmolded with an insulative layer produce a much more aesthetically pleasing appearance, as well as to assure the continuity of the shielding. However, this has created some problems in the past in that the overmolding operation generates very high pressures which have, in some instances, crushed the metal shield resulting in both destroying the electrical characteristics thereof as well as to allow flow of the overmold material into the terminal cavities freezing the terminals into fixed positions and often misaligned conditions.

The present invention overcomes the deficiencies of the prior art by providing a multipart metal enclosure for an electrical connector of known configuration. The known connector has an insulative housing containing a plurality of terminals in a like plurality of terminal passages and has a pair of metal shell members forming a peripheral mounting flange on the insulative housing. The subject invention includes a pair of mating metal shield members each of which has a forward end engageable with the metal shell members on the connector, interengaging integral side walls, and which together define an annular cable exit and a cavity. The metal shield members are further provided with strengthening embossments, pressure relief vent means, gripping apertures, and electrical continuity assurance means.

The present invention will now be described by way of example with reference to the accompanying drawings in which.

Figure 1:
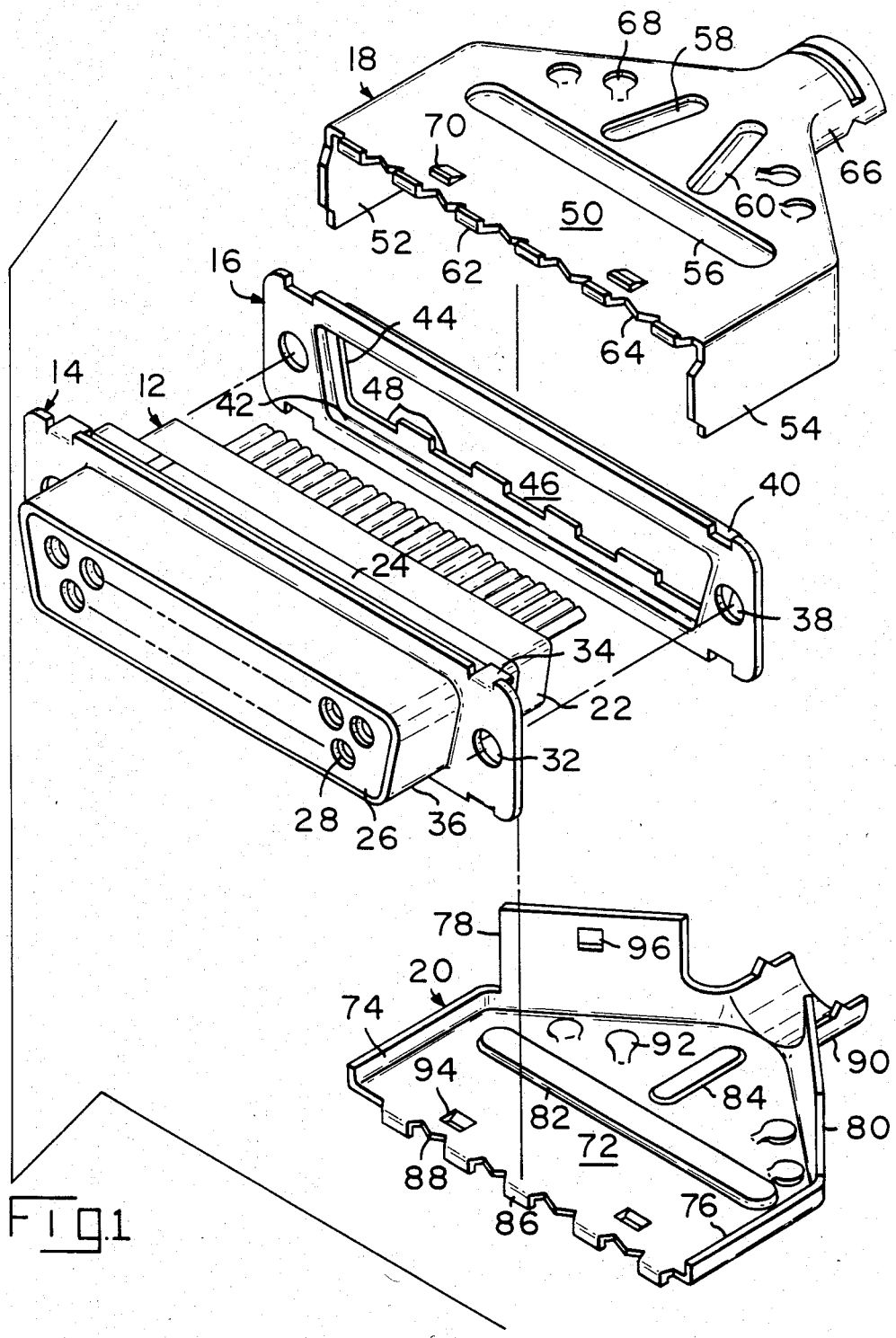
FIG. 1 is an exploded perspective view of the present invention together with a known electrical connector.

The subject shielded electrical connector assembly 10 is formed by a known electrical connector 12, first and second metal shells 14, 16 and a pair of metal shields 18, 20. The connector 12 shown in one of a well-known type, namely a miniature D connector of the type manufactured by the assignee, AMP Incorporated, and sold under the trade name AMPLIMITE. This connector 12 has an insulative housing 22 with an integral peripheral flange 24 and a front mating face 26 with a plurality of terminal passages 28 therein. Each passage 28 has a suitable terminal (not shown) mounted therein and used to terminate the respective conductors of a cable 30.

The metal shells 14 and 16 are each integral stamped and formed metal members. The front shell 14 has mounting apertures 32 and gripping lugs 34 and is received against the front surface of the flange 24. The front shell 14 can be provided with an integral shroud 36 enclosing the forward end of the housing 22. The rear shell 16 has a similar outer profile with apertures 38 aligned with the apertures 32 and recesses 40 aligned to receive the respective lugs 34. The rear shell 16 is also profiled to define a cavity 42, which receives a rear portion of the housing 22 of connector 12, as well as a rear flange 44 defining a central opening 46 and a plurality of recesses 48 along the marginal edges thereof.

The one rear shield 18 is a stamped and formed integral metal member having a generally planar wall 50 surrounded by depending long side walls 52, 54 and short side walls (not shown). The planar wall 50 is profiled to have a first transverse embossment 56, second diverging embossments 58, 60, forwardly directed hooked gripping tines 62, intervening forwardly directed protuberances or lances 64, a semicylindrical rearwardly directed cable exit 66, at least one pressure relief means 68, and at least one overmold grip means 70.

The other rear shield 20 is somewhat similar to shield 18, having a planar wall 72 surrounded by short side walls 74, 76 and long side walls 78, 80, a first transverse embossment 82, a second embossment 84, forwardly directed hooked gripping tines 86, forwardly directed protuberances or lances 88, rearwardly directed semicylindrical cable exit 90, pressure relief means 92, overmold gripping means 94, and latching lugs 96.

Figure 2:
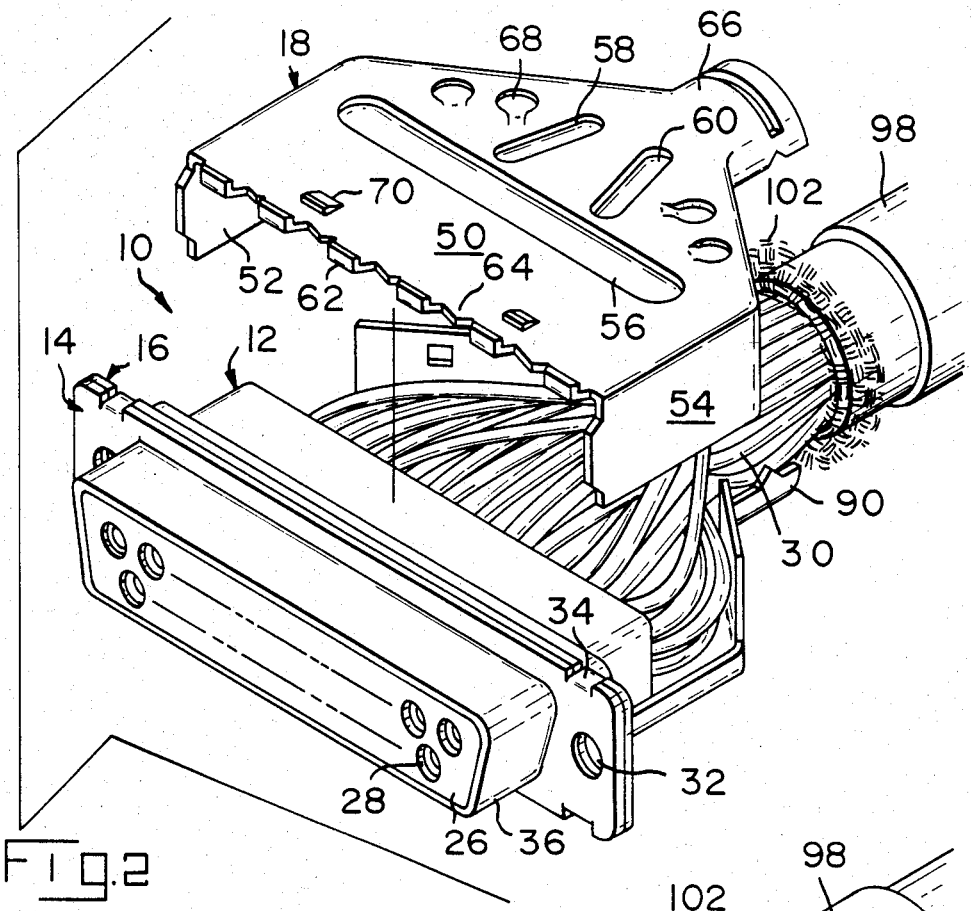
FIG. 2 is a view similar to FIG. 1 showing the subject connector in a partially assembled condition with only one shield member exploded therefrom.
Figure 3:
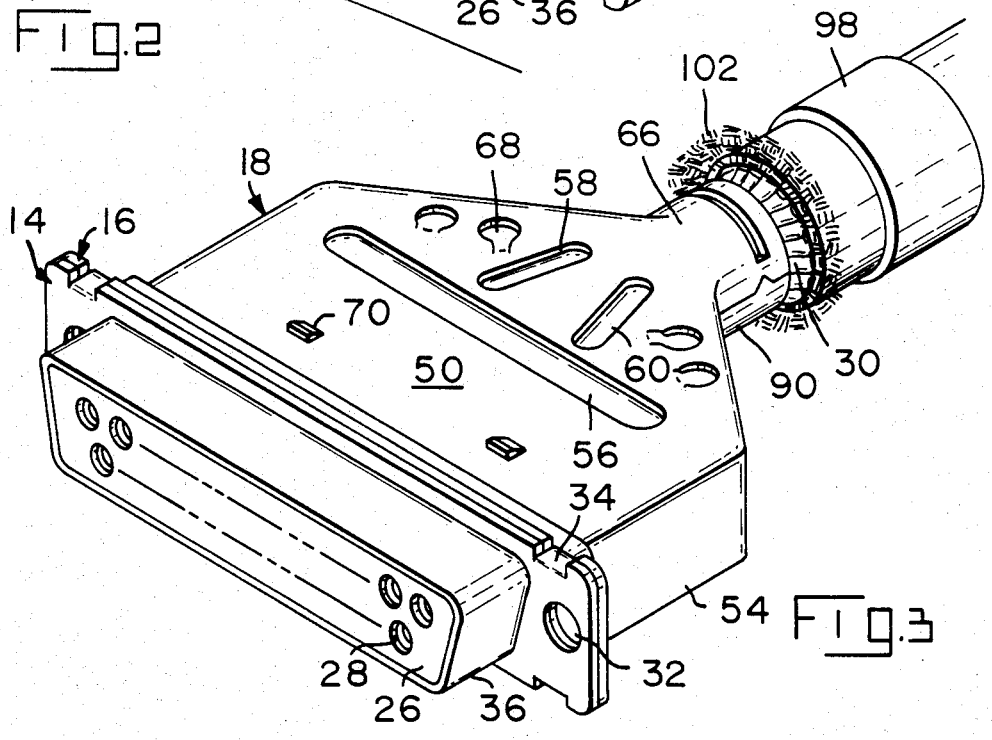
FIG. 3 is a view similar to FIGS. 1 and 2 showing the subject invention in a fully assembled condition.
Figure 4:
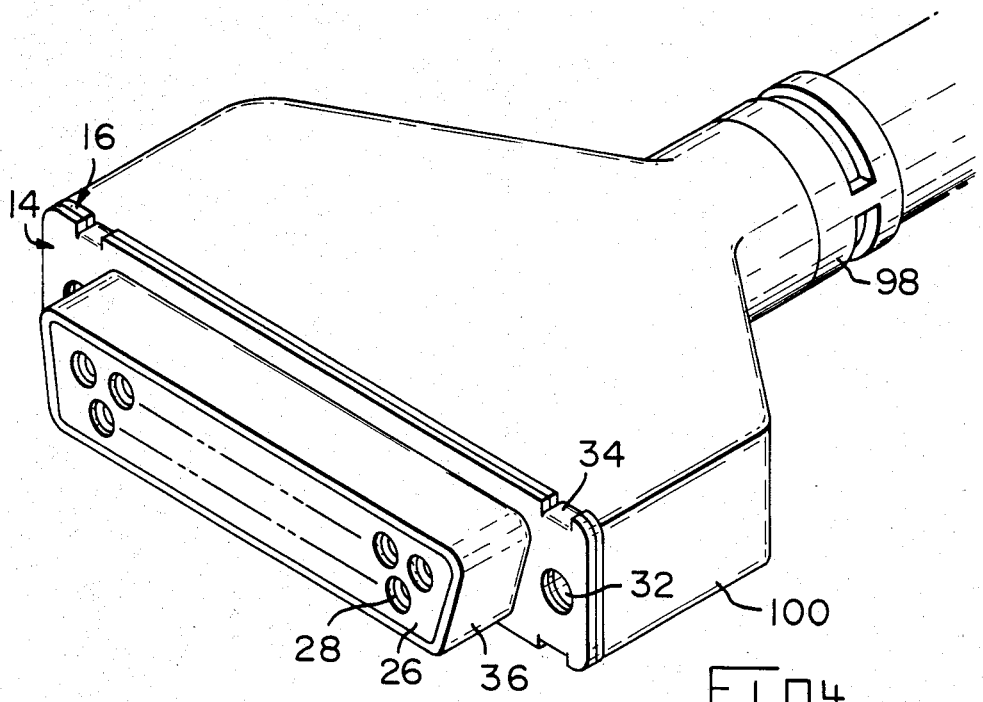
FIG. 4 is a view similar to FIGS. 1 through 3 showing the subject invention after the overmolding operation.

The electrical connector 12 and the shells 14, 16 are formed and assembled in the usual manner and the connector is loaded with terminals. These terminals are then used to engage and terminate the appropriate conductors of the cable 30 in any well-known manner, such as crimping or insulation piercing. It should be pointed out that, in this assembled condition, the shells 14, 16 are joined on opposite sides of the flange 24 and are secured together by the lugs 34 being clinched over recesses 40 in the rear shell 16. The rear shields 18, 20 are applied by putting the tines 62, 86 into the respective recesses 48 and appropriately aligning the shields as shown in FIG. 2. The rear shields 18, 20 are rotated relative to each other so that the side walls 52, 54 overlap the respective side walls 74, 76 while side walls 78, 80 are received within the rear side walls (not shown) of the shield 18 and form a latching engagement therewith. The rear side walls 78, 80 will engage the top shield 18 and serve to strengthen the shield during the overmold operation. It should be noted that as the shields 18, 20 are rotated, the protuberances 64, 88 will make a resilient interference engagement with the rear shell 16, to the extent a certain amount of spring action must be overcome to close the shields. The stored energy thus produced assures electrical continuity. The subject connector assembly of FIG. 3 is now ready for the overmolding operation, FIG. 4 showing the subject connector assembly with overmolding 100 in place.

Figure 8:
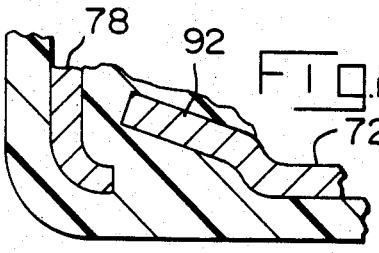
FIG. 8 is a partial section similar to FIG. 6 but taken after the overmolding operation.

An overmolding operation can develop tremendous pressures on the metal shields and could crush them into the cavity they form. For this reason the pressure relief means 68, 92 are provided. While they are shown in a generally circular shape, they are not limited to any particular geometric configuration. The primary feature of the pressure relief means 68, 92 is that they are stamped and formed so that a majority of their peripheral surface is substantially free from the adjacent shell and the connecting or hinge portion is substantially parallel to the path of wires within the shield. This prevents the wires from being damaged by the pressure relief means opening. It can be readily understood by those skilled in the art how the size, shape and location of the pressure relief means can be engineered to open when predetermined molding pressures are achieved, and for this reason complete separation of the periphery is not essential. Opening of the pressure relief means allows for some of the overmold material 100 to flow into the cavity formed by these shields 18, 20, as shown in FIG. 8. It will be appreciated that opening of the pressure relief means will accomplish several things. First, it will relieve the pressure of the overmolding operation. Second, it will allow balancing of the pressure within the shields. And third, it will allow an amount of the overmold material to flow into the cavity. The amount of material entering the cavity can be controlled to secure the conductors of the cable and prevent backout of the terminals carried by the connector without affecting terminal alignment.

Alternative pressure relief means could include apertures or bores in the shield members covered by tape or frangible diaphragms. When sufficient overmolding pressure is reached, the aperture or bore cover would give way before structural damage occurs to the shield members.

Figure 9:
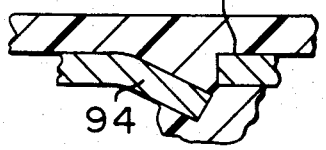
FIG. 9 is a partial section similar to FIG. 7 but taken after the overmolding operation.

The gripping means 70, 94 each also allow a limited amount of overmold material 100 to flow into the central cavity, as shown in FIG. 9. These gripping means 70, 94 form shoulders adjacent to and directed toward the front edge of the shields. The overmold material 100 flows against gripping means 70, 94 and hardens, it will be prevented from pulling back or shrinking as the overall overmold material 100 cools. Thus, an overmolded connector having a good appearance, such as shown in FIG. 4, will be formed.

The shields 18, 20 are provided with first embossments 56, 82 which are parallel and oppositely spaced and serve as strengthening means. The shields 18, 20 also have second embossments 58, 60, 84 which run generally in line with the spreading direction of the conductors of the cable 30. This assures that there will be no possibility of the conductors being crushed and/or shorted should the shields 18, 20 collapse.

Figure 10:
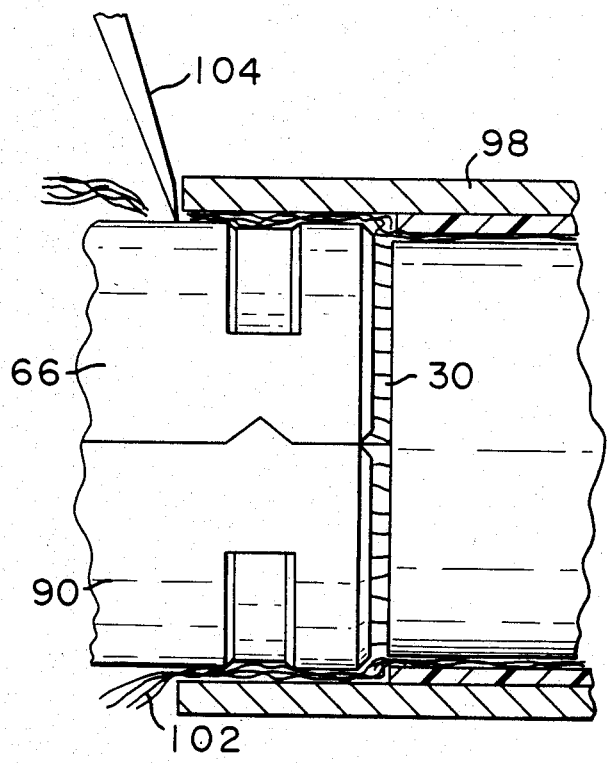
FIG. 10 is a side elevation, partially in section, showing trimming of the cable shield prior to overmolding.
Figure 5:
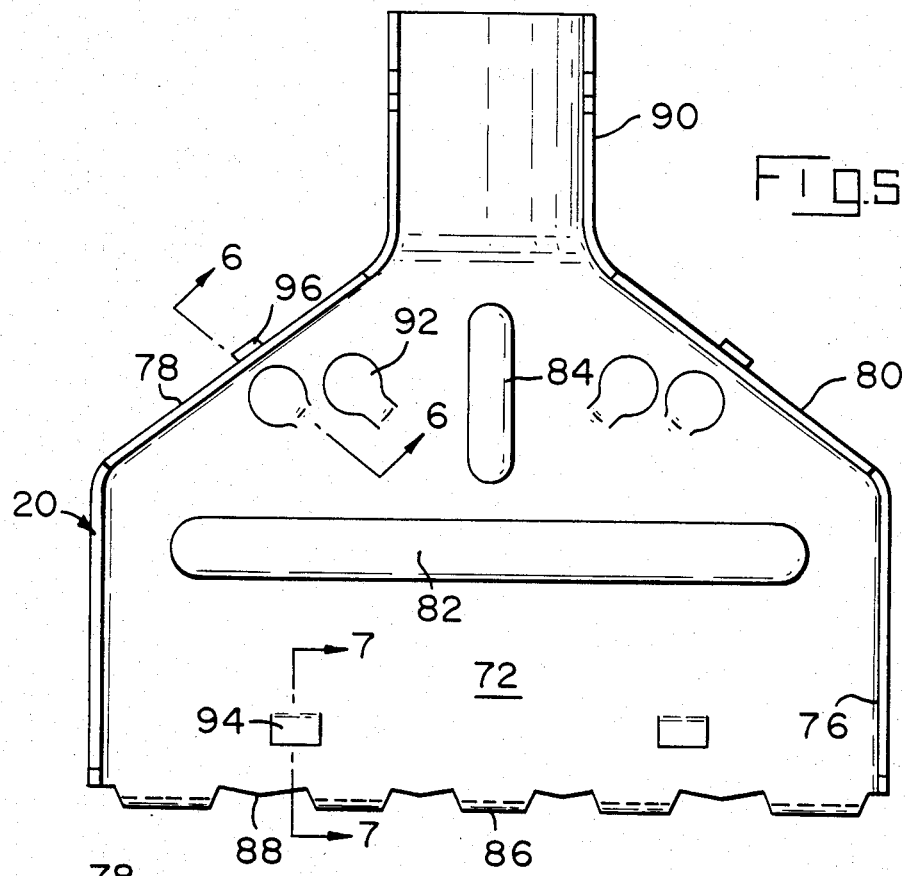
FIG. 5 is a plan view of one shield member of the subject invention.
Figure 6:
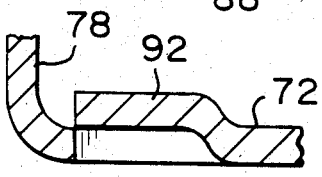
FIG. 6 is a partial section taken along line 6—6 of FIG. 5.
Figure 7:
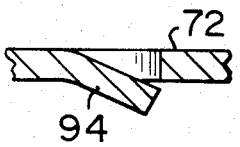
FIG. 7 is a partial section taken along line 7—7 of FIG. 5.

A further advantage of the present invention is shown in FIG. 10. The shielding 102 of the shielded multiconductor cable 30 is dressed over the outside of the cable exit portions 66, 90 of the shields 18, 20 and secured thereto by a crimp ring 98. The outer surface of the cable exit portions 66, 90 can have profiles, serrations and/or grooves to enhance gripping of the cable shield. The shielding 102 can be neatly trimmed with a knife 104 with no fear of damaging the cable as the shields 18, 20 form a metal backup for the knife. The connector can now be overmolded without the cable shield projecting through the overmold material. The crimp ring 98 can also be used as a stop for the overmold material during the overmolding operation.

We claim:

1. A shielded electrical connector comprising an insulative housing having a front mating face, a rear conductor receiving face, and a plurality of terminals mounted therein, metal shell means mounted on the periphery of said housing between said faces, said shell means having an aperture therethrough, a pair of stamped and formed metal shields enclosing the rear conductor receiving face of the housing and a cavity extending rearward therefrom, said shields each having hooked tines which engage said shell means proximate said aperture as said shields are rotated about said tines and into engagement to form said cavity, at least one of said shields having protuberance means thereon which engages said shell means in interference so as to oppose rotation of said shields, by resilient engagement between said protuberance means and said shell means, thereby forming a stored energy preload condition assuring electrical continuity between said shell means and said shields when said shields are engaged.

2. A connector as in claim 1 wherein said aperture is profiled with recesses along the marginal edge thereof, said tines engaging said recesses.

3. A connector as in claim 1 wherein said protuberance means comprises at least one protuberance on each shield.

4. A connector as in claim 3 wherein said at least one protuberance lies between a pair of tines.

5. A connector as in claim 1 wherein said aperture is profiled with recesses along the marginal edges thereof, said tines engaging said recesses, said protuberance means comprising at least one protuberance on each shield, said at least one protuberance lying between a pair of tines and engaging said shell means proximate said aperture between a respective pair of recesses.

6. A shielded electrical connector comprising an insulative housing having a front mating face, a rear conductor receiving face, and a plurality of terminals mounted therein, metal shell means mounted on the periphery of said housing between said faces, said shell means having an aperture therethrough, said aperture being profiled with recesses along the marginal edges thereof, a pair of stamped and formed metal shields enclosing the rear conductor receiving face of the housing and a cavity extending rearward therefrom, said shields each having hooked tines which are received in respective ones of said recesses and engage said shell means as said shields are rotated about said tines and into engagement to form said cavity, each said shield engaging said shell means in resilient interference between each pair of recesses when said shields are engaged so as to oppose rotation of said shields, thus forming a stored energy preload condition, whereby electrical continuity between the shell means and the shields is assured.

7. A shielded electrical connector as in claim 6 wherein each shield has a protuberance lying between each pair of tines, each said protuberance engaging said shell means in resilient interference between a pair of recesses.

* * * * *